United States Patent [19]

Andary

[11] 4,331,324

[45] May 25, 1982

[54] LIFT DEVICE FOR PINBALL GAME

[75] Inventor: Eddie J. Andary, Avacado Heights, Calif.

[73] Assignee: Wico Corporation, Niles, Ill.

[21] Appl. No.: 144,969

[22] Filed: Apr. 29, 1980

[51] Int. Cl.[3] ..... B66F 5/04

[52] U.S. Cl. ..... 254/2 R

[58] Field of Search ..... 254/2 R, 2 C, 9 R, 9 C, 254/10 R, 10 C, 4 R, 4 C, 122, 126, 124; 414/495, 498, 11

[56] References Cited

U.S. PATENT DOCUMENTS

| | | | |
|---|---|---|---|
| 2,356,913 | 8/1944 | Berman | 254/10 C |
| 3,317,187 | 5/1967 | Steppon | 254/126 |
| 3,438,514 | 4/1969 | Bose et al. | 414/11 |
| 4,114,854 | 9/1978 | Clark | 414/495 |
| 4,123,038 | 10/1978 | Meyers | 254/2 R |

*Primary Examiner*—Robert C. Watson

*Attorney, Agent, or Firm*—Dithmar, Stotland, Stratman & Levy

[57] ABSTRACT

A lightweight portable lift device for lifting and moving pinball games includes a generally H-shaped horizontal carriage including side beams interconnected intermediate the ends thereof by two closely-spaced crossbeams. Two vertical posts are respectively removably receivable between the crossbeams outboard of the side beams and supported by the carriage, each of said posts comprising telescoping tubes with the inner tubes having longitudinally spaced-apart apertures diametrically therethrough and having the upper ends thereof connected to a small platform engageable with the bottom of an associated pinball game. Jack mechanism is mounted on the crossbeams or on the posts and is coupled to the platform for raising and lowering thereof. Pins tethered to the device are receivable in the post apertures for locking the platform at any predetermined height and removing the load from the jack mechanism. The crossbeams may be pivotally connected to the side beams to provide a foldable carriage. The posts are dimensioned substantially to fill the space between the crossbeams to prevent accidental folding thereof in use. An auxiliary platform is mountable directly on the carriage for use thereof as a dolly.

4 Claims, 10 Drawing Figures

LIFT DEVICE FOR PINBALL GAME

BACKGROUND OF THE INVENTION

The present invention relates to a lift device for lifting and moving pinball games. Pinball games typically are mounted well above the floor on upstanding support legs, and they are normally quite heavy. Furthermore, pinball games include a considerable amount of rather delicate mechanisms which can be easily damaged by rough handling. Accordingly, there have heretofore been provided lift devices for lifting and moving pinball games. These prior lift devices typically comprise a box-shaped wheeled carriage which is dimensioned to be moved beneath the pinball game between the support legs thereof. The carriage is approximately the same length as the pinball game and has a height slightly less than the elevation of the pinball game. Mounted on the box-like carriage is an elevator mechanism supporting a large rectangular platform which is engageable with the bottom of the pinball game and can be raised and lowered for raising and lowering the pinball game.

While these prior lift devices operate quite satisfactorily, they are extremely large, heavy and unwieldy devices. Thus, while these prior lift devices are operable to permit one man to lift and move a pinball game, they are so heavy and bulky that it takes two men to move the lift device itself, particularly in the case of carrying the lift device up and down stairs, lifting it onto and off of trucks and the like. Furthermore, the size of the prior lift devices makes it difficult to maneuver them in close quarters.

SUMMARY OF THE INVENTION

The present invention relates to an improved lift device for pinball games, which avoids the disadvantages of prior art lift devices while affording other structural and operating advantages.

It is a general object of this invention to provide a lift device for a pinball game, wherein the lift device is lightweight and readily portable by one man.

It is another object of this invention to provide a lift device of the type set forth which is relatively small, compact and easily maneuverable, and which includes a low carriage and a vertically-extensible support frame removably mountable on the carriage.

Still another object of this invention is to provide a lift device of the type set forth, which includes means for locking the device in an elevated position to remove the load from the lifting mechanism.

Still another object of this invention is to provide a lift device of the type set forth, which includes a carriage which is foldable when not in use.

These and other objects of the invention are attained by providing a lightweight portable lift device for lifting and moving a pinball game supported above the floor on upstanding support legs, the lift device comprising a mobile carriage adapted to be moved beneath the associated pinball game between the support legs thereof, an upstanding support frame mounted on the carriage and including two substantially parallel upright posts having longitudinal axes defining a support plane, the support frame extending horizontally only a very slight distance beyond the support plane, a platform carried by the support frame and engageable with the bottom of the associated pinball game and movable with respect to the support frame between a fully lowered and a fully raised position, and drive means carried by the carriage and coupled to the platform for effecting movement thereof between the fully lowered and the fully raised positions thereof thereby to raise and lower the associated pinball game.

Further features of the invention pertain to the particular arrangement of the parts of the lift device whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
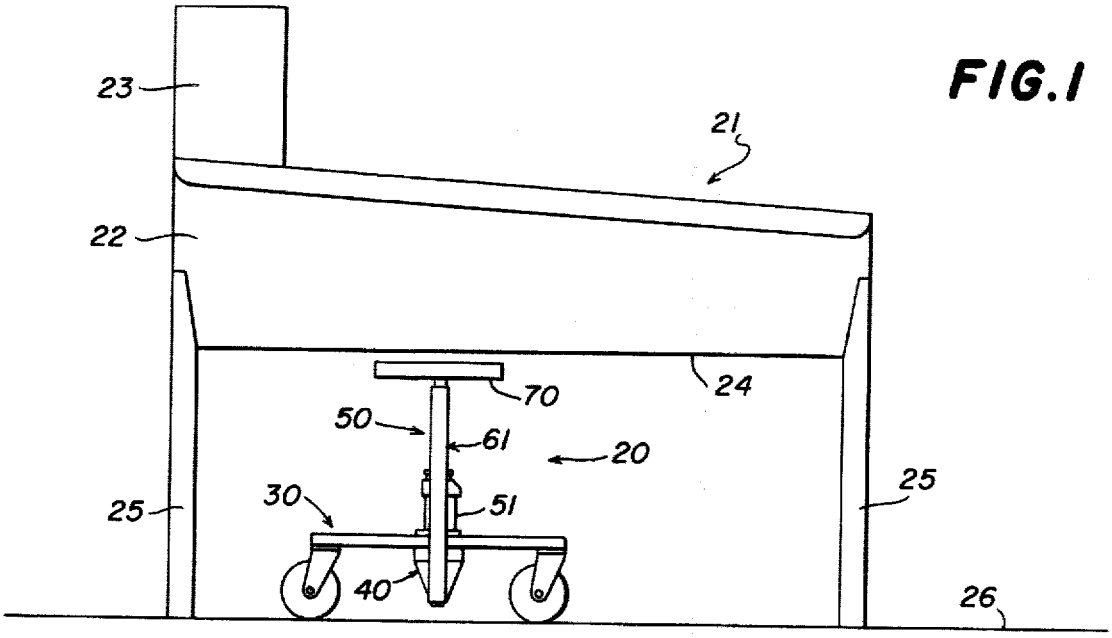
FIG. 1 is a side elevational view of a lift device constructed in accordance with and embodying the features of the present invention, and disposed for use beneath an associated pinball game.
Figure 2:
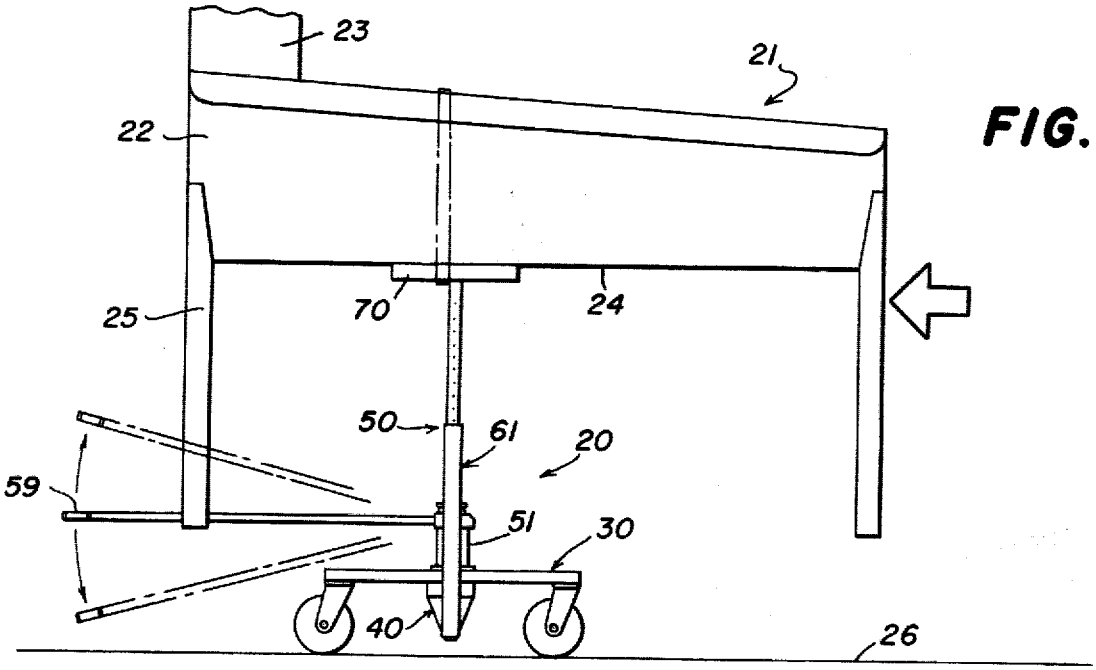
FIG. 2 is a view similar to FIG. 1, showing the lift device supporting the pinball game in an elevated position.

Referring to FIGS. 1 and 2 of the drawings, there is illustrated a lift device, generally designated by the numeral 20, for lifting and moving a pinball game 21. The pinball game 21 has a horizontally disposed cabinet 22 which contains the playing field, and an upstanding vertical cabinet 23 at one end of the cabinet 22, which typically contains scoring displays and the like. The horizontal cabinet 22 has a flat planar substantially horizontal bottom wall 24. Typically, the pinball game 21 is supported well above the floor 26 or other support surface by four upstanding support legs 25.

Referring now also to FIGS. 4 through 7 of the drawings, the lift device 20 includes a mobile carriage, generally designated by the numeral 30, having mounted thereon an upstanding elevator structure, generally designated by the numeral 50. The carriage 30 comprises a generally H-shaped horizontal frame which includes two parallel, spaced-apart side beams 31. Respectively connected to the ends of the side beams 31 by bolts 32 are four casters 33 and associated wheels 34. The side beams 31 are interconnected intermediate the ends thereof by two closely-spaced parallel crossbeams 35, which are preferably disposed beneath the side beams 31 substantially perpendicular thereto and are secured thereto by bolts 36. The crossbeams 35 extend outwardly a predetermined distance beyond each of the side beams 31 for cooperation therewith to define two rectangular recesses or pockets 37 for a purpose to be described more fully below. Each of the side beams 31 and crossbeams 35 is preferably of hollow tubular construction, substantially rectangular in transverse cross section. A flat, rectangular brace plate 38 overlies the crossbeams 35 centrally thereof and is fixedly secured thereto as by welding or by suitable fasteners 39 for rigidly holding the carriage 30 in the H-shaped configuration illustrated in FIG. 7.

Figure 6:
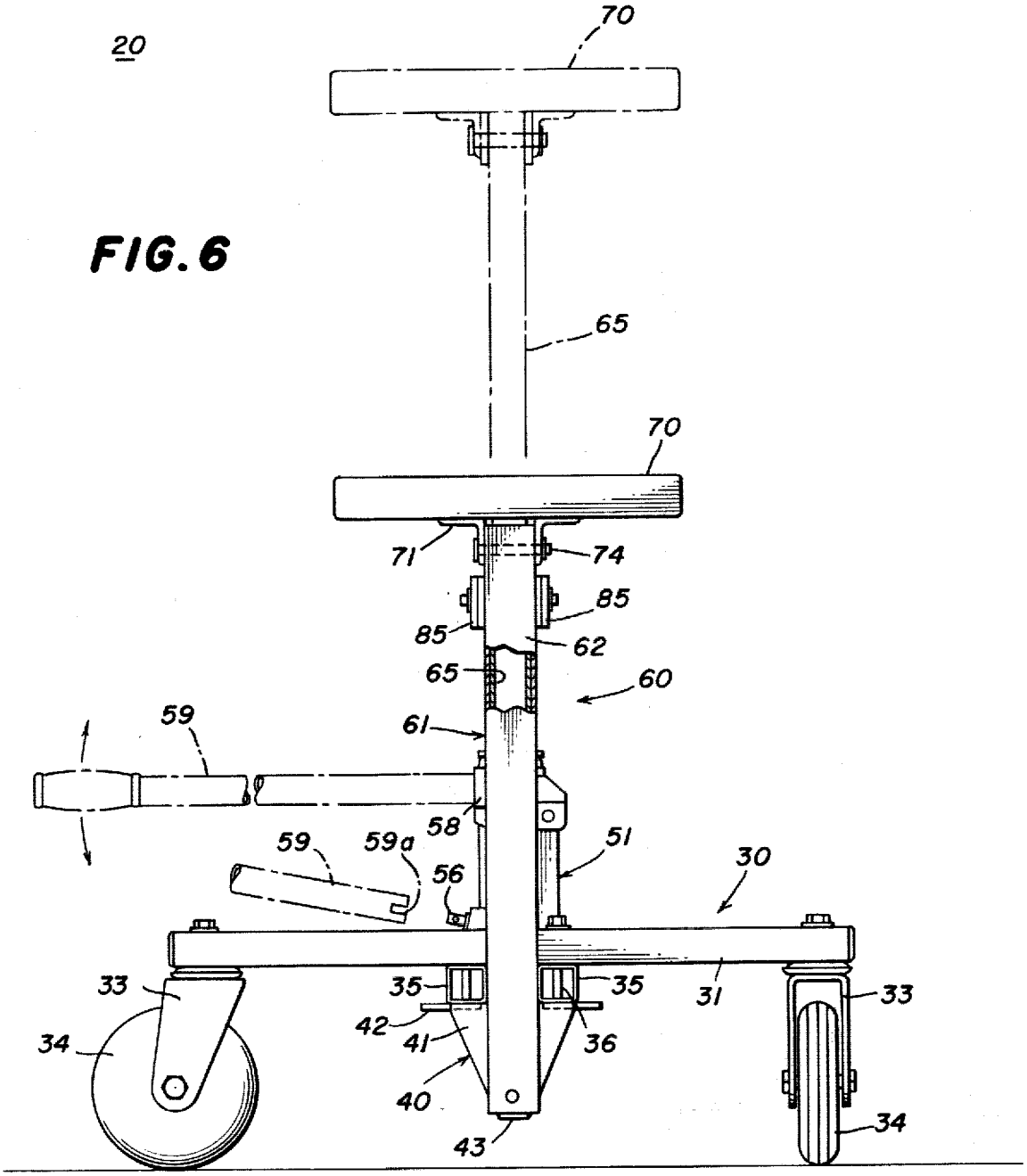
FIG. 6 is an enlarged side elevational view of the lift device illustrated in FIG. 1, with portions broken away more clearly to illustrate the construction, and with the elevator structure illustrated in its lowered position in solid line and in its raised position in broken line.

In normal use, the side beams 31 are arranged to be parallel to the direction of straight-ahead movement of the carriage 30 and, if desired, the casters at one end of the side beams 31 may be freely swiveling, while the casters 33 at the other ends of the side beams 31 may be locked in the orientation illustrated at the left-hand end of FIG. 6 to facilitate control of the carriage 30 during straight-ahead movement. The crossbeams 35 have a length comparable to and preferably slightly less than the width of the cabinet 22 of the pinball game 21, and the side beams 31 have a length slightly less than the length of the crossbeams 35, thereby to provide a very compact structure in comparison to the size of the pinball game 21.

Fixedly secured to the crossbeams 35, respectively adjacent to the opposite ends thereof are two support brackets, generally designated by the numeral 40. Each of the support brackets includes a generally triangular main plate 41 arranged substantially vertically in use, and provided at the broad upper end thereof with an attachment flange 42 extending from the main plate 41 substantially normal thereto inwardly of the carriage 30, and disposed in use beneath and spanning the adjacent ends of the crossbeams 35 for connection thereto by the bolts 36. Extending outwardly from the lower narrow end of the main plate 41 substantially normal thereto opposite to the direction of the attachment flange 42 is a short support flange 43, for a purpose to be explained hereinafter.

The elevator structure 50 includes a hydraulic jack, generally designated by the numeral 51, having an enlarged base 52 which rests upon and is fixedly secured by suitable fasteners to the brace plate 38 of the carriage 30. The hydraulic jack 51 includes an upstanding cylinder 53, from the upper end of which projects a piston rod 54 having fixedly secured to the upper end thereof a clevis bracket 55. The hydraulic jack 51 has a valve stem 56 provided with a cotter pin 57 extending diametrically therethrough. There is also provided a lever socket 58 in which is received one end of a lever handle 59 for elevating the piston rod 54 in a well-known manner. Preferably, the handle 59 is hollow and is provided with a slot **59*a* in the end thereof so as to be receivable over the valve stem 56 with the cotter pin 57 engaged in the slot 59*a* for rotating the valve stem 56 to relieve the pressure in the cylinder 53 for lowering the piston rod 54**.

Figures 4, 5:
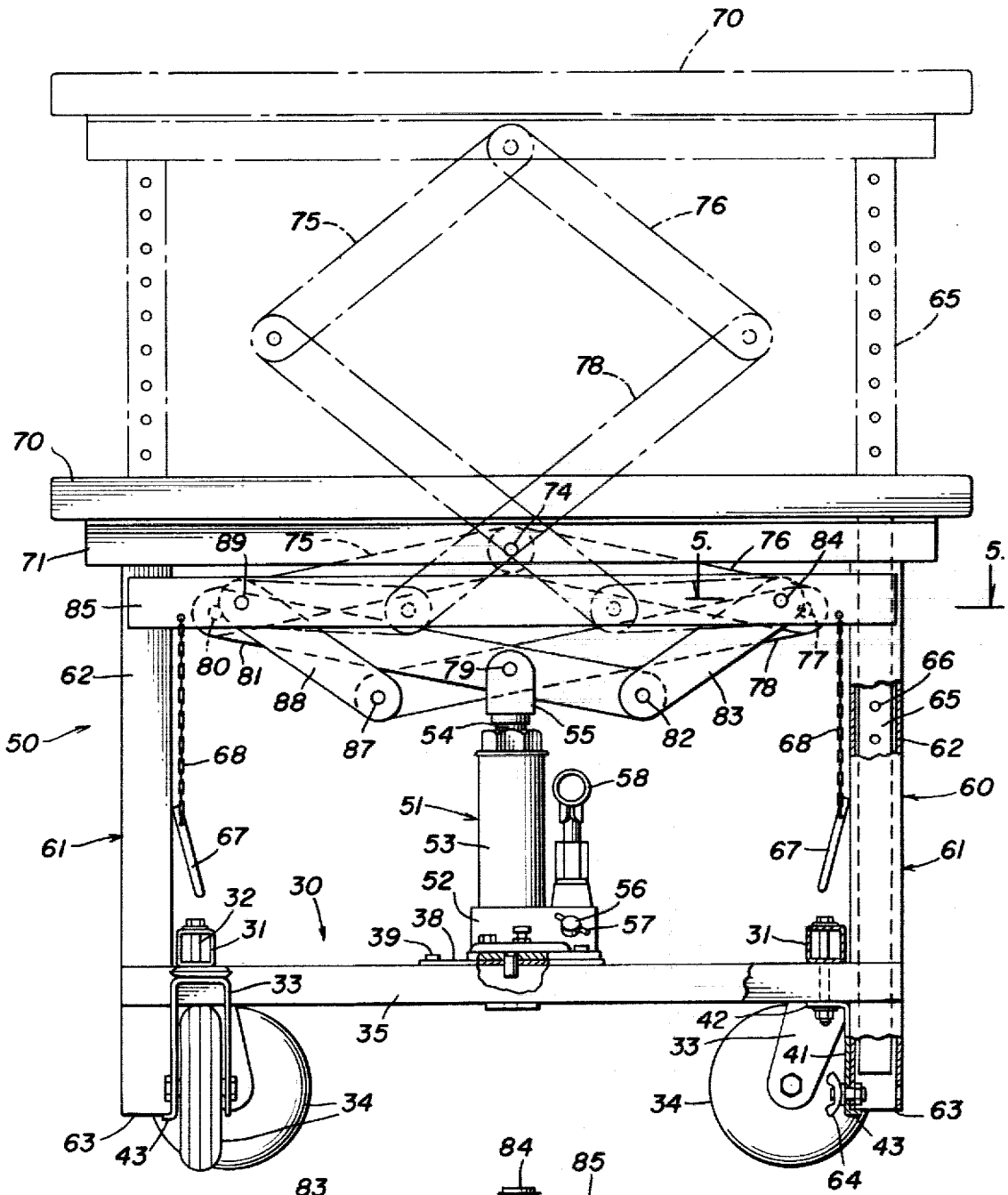
FIG. 4 is an enlarged front elevational view of the lift device of FIG. 1, with portions thereof broken away more clearly to illustrate the construction, and with the elevator structure illustrated in its lowered position in solid line and in its raised position in broken line.
FIG. 5 is a further enlarged fragmentary view in horizontal section taken along the line 5—5 in FIG. 4.

The elevator structure 50 also includes an upright frame, generally designated by the numeral 60, which is removably mountable on the carriage 30 and includes two parallel, substantially vertical posts 61, each of which comprises a hollow outer tube 62 having telescopically slidable therein a hollow inner tube 65, the tubes 62 and 65 both preferably being rectangular in transverse cross section. The outer tubes 62 are respectively received in the pockets 37 between the outer ends of the crossbeams 35. The lower ends 63 of the outer tubes 62 respectively rest upon the support flanges 43 of the support brackets 40, as is best illustrated in FIGS. 4 and 6, and may be fixedly secured to the support brackets 40 by fasteners 64 extending through complementary openings in the main plates 41 of the support brackets 40 and the side walls of the outer tubes 62. Preferably, the distance between the crossbeams 35 is very slightly greater than the thickness of the outer tubes 62 of the posts 61, so that the crossbeams 35 and the adjacent portions of the side beams 31 cooperate to prevent lateral movement of the posts 61. Each of the inner tubes 65 has a plurality of longitudinally spaced-apart holes 66 extending diametrically therethrough and adapted to receive therein an associated latch pin 67 for locking the inner tubes 65 at any desired elevation. Preferably, two of the latch pins 67 are provided, one for each of the posts 61, and are tethered to the upright frame 60 by chains 68.

A rectangular platform 70 is carried by the inner tubes 65 of the posts 61. More specifically, fixedly secured to the bottom of the platform 70 and extending transversely thereof are two parallel elongated angle irons 71, spaced apart a distance very slightly greater than the thickness of the inner tubes 65. The upper ends of the inner tubes 65 are received between the depending flanges of the angle irons 71 respectively adjacent to the opposite ends thereof and are fixedly secured thereto by suitable bolts. The long dimension of the platform 70 extends parallel to the crossbeams 35 and is comparable to the width of the cabinet 22 of the pinball game 21. The platform 70 may be padded with any suitable material to prevent damage to the pinball game 21, and is preferably covered with rubber or other suitable nonskid material. Alternatively, strips of nonskid material may be provided on the upper surface of the platform 70.

The platform 70 is coupled to the clevis bracket 55 of the hydraulic jack 51 by a scissors-type linkage assembly. More specifically, a pivot pin 74 extends through the depending flanges of the angle irons 71 intermediate the ends thereof for pivotally connecting thereto the adjacent ends of a relatively thick link arm 75 and a pair of relatively thin link arms 76. The other ends of the link arms 76 are pivotally coupled by a pin 77 to one end of a relatively thick arm 78, which is pivotally coupled intermediate its ends to the clevis bracket 55 by a pivot pin 79. The other end of the link arm 75 is pivotally coupled by a pivot pin 80 to one end of a pair of relatively thin arms 81, which are pivotally coupled intermediate the ends thereof to the clevis bracket 55 by the pivot pin 79. The other ends of the arms 81 are pivotally coupled by a pivot pin 82 to the adjacent ends of a pair of offset arms 83, the other ends of which are respectively pivotally coupled by pivot pins 84 to two horizontal crossbars 85, the ends of which are respectively fixedly secured as by welding to the outer tubes 62 of the posts 61 adjacent to the upper ends thereof to form part of the upright frame 60 (see FIGS. 4 and 5). The other end of the arm 78 is pivotally coupled by a pivot pin 87 to the adjacent ends of a pair of offset arms 88, the other ends of which are respectively pivotally coupled by pivot pins 89 to the crossbars 85. As can be seen from FIG. 5, the crossbars 85 are offset so as to provide sufficient space therebetween to accommodate the linkage mechanism.

In use, the carriage 30, with the elevator assembly mounted thereon, is rolled beneath the associated pinball game 21 to be lifted. In this regard, it will be noted that the height of the upright frame 60 is such that when the platform 70 is in its fully lowered position, illustrated in solid line in FIGS. 4 and 6, the total height of the lift device 20 is less than the height of the bottom wall 24 of the pinball game 21. The lift device 20 is preferably positioned so that the crossbeams 35 and the platform 70 extend laterally of the pinball game 21, the platform 70 being disposed intermediate the ends of the pinball game cabinet 22 as close as possible to the balance point, which is generally toward the head end thereof. The handle 59 is inserted into the socket 58 of the hydraulic jack 51 for manipulation thereof to elevate the piston rod 54. The piston rod 54 operates through the clevis bracket 55 and the linkage mechanism in a well-known fashion to elevate the platform 70, this elevation being accommodated by the sliding of the inner tubes 65 with respect to the outer tubes 62 of the posts 61.

As the platform 70 is elevated, it engages the bottom wall 24 of the pinball game 21 and lifts the pinball game 21 off of the floor 26. When the pinball game 21 has been elevated to the desired height, the latch pins 67 are inserted into the holes 66 of the inner tubes 65 immediately above the upper ends of the outer tubes 62, thereby to lock the elevator assembly 50 at the predetermined elevation and relieve the load from the hydraulic jack 51. The lift device 20, with the pinball game 21 mounted thereon, may then easily be moved along the floor 26 by one man. If desired, hooks or the like (not shown) may be provided on the platform 70 to facilitate connection thereto of straps for strapping the pinball game 21 in place on the platform 70.

It is a significant feature of the present invention that the unique H-shaped configuration of the carriage 30 affords great flexibility and ease of maneuverability in use. Thus, even though the length of the side beams 31 and the crossbeams 35 may be slightly greater than the spacing between the front legs 25 of the pinball game 21, the lift device 20 may nevertheless be moved between these front legs 25 by angling the carriage 30 to move first one end of one side beam 31 between the legs, and then pivot the carriage 30 to move the other ends of the side beams 31 between the legs in much the same way as a table is moved through a narrow doorway. This feature is particularly useful where there is no access from the side of the pinball game, such as when a number of pinball games are arranged in side-by-side relationship. Further, if the platform 70, which is the longest member of the lift device 20, extends beyond the sides of the pinball game 21 a distance so as to inhibit passage through a narrow doorway, the carriage 30 can be swung to arrange the platform 70 longitudinally of the pinball game 21 so that there is no lateral overhang.

It is another significant aspect of the present invention that the lift device 20 is compact and lightweight so as to be readily portable by one man. The overall dimensions of the carriage 30 are substantially less than those of the pinball game 21 and the open H-shaped framework of the carriage 30 and the flat upright frame 60 contribute to a lightweight construction. Furthermore, the fact that the upright frame 60 and the attached platform 70 are removable from the carriage 30 greatly facilitates portability. Thus, the upright frame 60 can be removed and carried in one hand while the carriage 30 is carried in the other hand of a user. In this regard, it will be noted that while the preferred embodiment has disclosed fasteners 64 for securing the posts 61 to the support brackets 40, an alternative construction (not shown) could provide an upstanding lip on the support flanges 43 which would extend up inside the bottoms of the outer tubes 62 to prevent lateral movement of the posts 61 with respect to the support brackets 40. Such a construction would greatly facilitate assembly and disassembly of the upright frame 60 with respect to the carriage 30.

Also, while the preferred embodiment has illustrated the posts 61 disposed outboard of the side beams 31, it will be understood that they could be arranged to be disposed between the crossbeams 35 inboard of the side beams 31. In this arrangement, the support brackets 40 would be turned so that the support flanges 43 thereof extend inwardly. In such an embodiment, the overall width of the lift device 20 could be reduced by eliminating the extensions of the crossbeams 35 outwardly beyond the side beams 31. While the lift device 20 is specifically designed for moving pinball games, it will be understood that it could be used for moving any heavy objects supported on upstanding legs, such as heavy pieces of furniture and the like.

Figure 3:
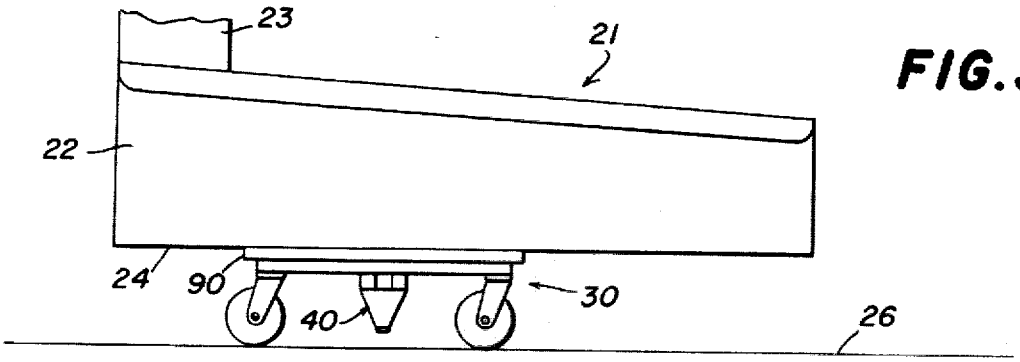
FIG. 3 is a fragmentary view similar to FIG. 1, illustrating the lift device with the elevator mechanism thereof removed and with a platform mounted directly on the carriage for use as a dolly.
Figure 8:
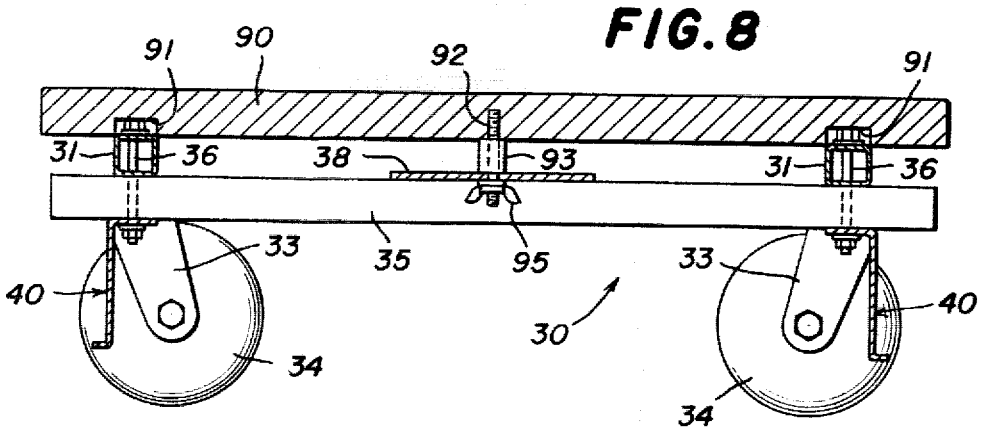
FIG. 8 is an enlarged view in vertical section taken along the line 8—8 in FIG. 7 and illustrating the dolly platform mounted in place on the carriage.
Figure 7:
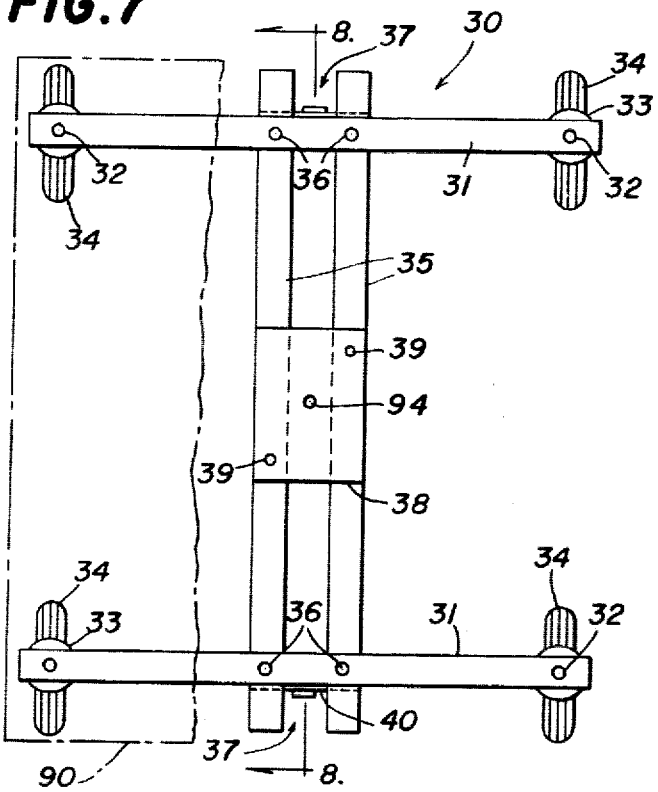
FIG. 7 is a top plan view of the carriage of the lift device of the present invention, with a dolly platform therefor partially illustrated in phantom.

Referring now also to FIGS. 3 and 8 of the drawings, there is illustrated an alternative use of the carriage 30 as a flatbed dolly. For this use of the device, the upright frame 60 is removed from the carriage 30 and there is provided a dolly platform 90 which is adapted to be mounted directly on the carriage 30. More specifically, the dolly platform 90 is provided with four recesses 91 in the lower surface thereof for accommodating the upper ends of the bolts 36 and allowing the dolly platform 90 to rest in a flat level position on the upper surfaces of the side beams 31. A threaded stud 92 may be provided centrally of the dolly platform 90 extending downwardly therefrom to be received through an aperture 94 in the brace plate 38 and secured thereto by a suitable nut 95 fixedly to mount the dolly platform 90 in place. A spacer sleeve 93 may be provided around the shank of the stud 92 between the brace plate 38 and the dolly platform 90. The dolly platform 90 may be used to support a pinball game 21 with the legs 25 thereof removed, or may be used to transport any other desired articles. Rectangular recesses or notches (not shown) may be provided respectively in the opposite side edges of the dolly platform 90 intermediate the ends thereof for accommodating the posts 61 of the upright frame 60. By this construction the upright frame 60 may be mounted on and demounted from the carriage 30 while the dolly platform 90 is in place thereon.

Figure 9:
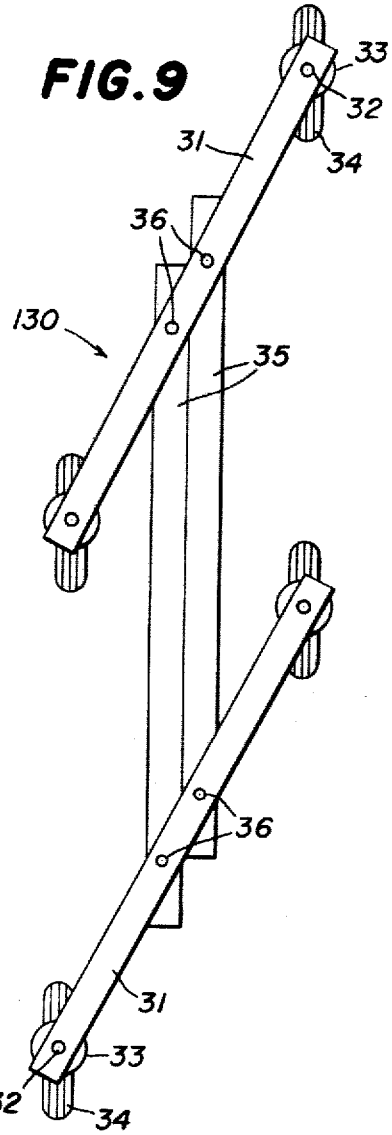
FIG. 9 is a top plan view of a modified foldable form of the lift device carriage.

Referring to FIG. 9 of the drawings, there is illustrated an alternative version of the carriage 30 wherein the brace plate 38 is removed. In this version of the invention, the bolts 36 interconnecting the side beams 31 and crossbeams 35 may serve as pivot pins permitting the side beams 31 and crossbeams 35 to be pivoted to a folded configuration illustrated in FIG. 9, wherein the crossbeams 35 are in side-by-side engagement with each other. This foldable carriage 130 permits further significant compacting of the carriage to facilitate handling and storage thereof. It is a significant aspect of the invention that when the foldable carriage 130 is arranged in its H-shaped use configuration, the posts 61 of the upright frame 60, when inserted into place in the pockets 37 will cooperate with the side beams 31 and crossbeams 35 to prevent accidental pivoting of the carriage 130 from its H-shaped use configuration toward its folded configuration. The brace plate 38 may be removably mounted by fasteners so that it can be readily mounted on the carriage 130 in its use configuration to support the hydraulic jack 51. Alternatively, the jack 51 may be mounted directly on the crossbeams 35.

Figure 10:
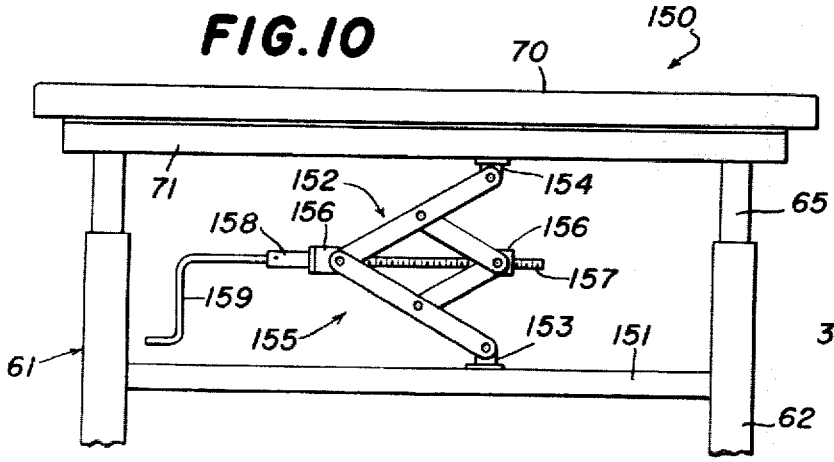
FIG. 10 is a fragmentary front elevational view of a second embodiment of elevator structure for the lift device of the present invention.

Referring now to FIG. 10 of the drawings, there is illustrated an alternative form of elevator assembly, generally designated by the numeral 150. In the elevator assembly 150 there are provided posts 61 and a platform 70 in the same manner as was described above with respect to the elevator assembly 50. But the elevator assembly 150 includes a crossbar 151 interconnecting the posts 61 intermediate the ends thereof. Mounted on the crossbar 151 is a scissors-type jack mechanism, generally designated by the numeral 155, which includes a parallelogram-type linkage 152 coupled to the crossbar 151 by a bracket 153 and coupled to the platform 70 by a bracket 154. The linkage 152 is connected to two nuts 156 which are threadedly engaged with an elongated screw 157. One of the nuts 156 has a socket 158 mounted thereon in which is received one end of a crank handle 159 for rotating the screw 157 to raise and lower the jack mechanism 155 in a well-known manner, thereby to raise and lower the platform 70. Preferably, the screw 157 has an acme coarse thread for smooth operation and resistance to stripping. The extra length on the linkage arms which are respectively coupled to the crossbar 151 on the platform 70 provides additional leverage and lifting force and a faster lift.

While a hydraulic jack and a scissors-type jack have been illustrated in the drawings, it will be understood that other suitable types of jack mechanisms could be used in the lift device 20. In a constructional model of the present invention the side beams 31, crossbeams 35, support brackets 40, posts 61, angle irons 71 and crossbars 85 and 151 are all preferably formed of steel. The platforms 70 and 90 may be formed of wood or any other suitable material, but are preferably covered with cushioning and nonskid material.

From the foregoing, it can be seen that there has been provided an improved lift device for pinball games which is lightweight and compact so as to be readily portable and operable by one man, and is designed for ease of maneuverability in tight spaces.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A lightweight portable lift device for lifting and moving a pinball game supported above the floor on upstanding support legs, said lift device comprising a generally H-shaped mobile carriage adapted to be moved beneath the associated pinball game between the support legs thereof, said carriage including two spaced-apart substantially parallel horizontal side beams and crossbeam structure interconnecting said side beams intermediate the ends thereof and substantially normal thereto, vertically extensible elevator structure carried by said crossbeam structure and engageable with the bottom of the associated pinball game, said elevator structure being movable between a fully lowered position and a fully raised position, drive means carried by said crossbeam structure for effecting movement of said elevator structure between the fully lowered and fully raised positions thereof thereby to effect raising and lowering of the associated pinball game, a dolly platform mountable directly on said carriage for use thereof as a dolly, and means removably mounting said elevator structure on said carriage to facilitate mounting of said dolly platform thereon.

2. The lift device of claim 1, and further including four wheel assemblies respectively mounted on the opposite ends of said side beams.

3. The lift device of claim 1, wherein said elevator structure includes a platform engageable with the bottom of the associated pinball game.

4. The lift device of claim 1, wherein said drive means includes a hydraulic jack mechanism mounted on said crossbeam structure.

* * * * *